US007359097B2

(12) United States Patent
Oomori et al.

(10) Patent No.: US 7,359,097 B2
(45) Date of Patent: Apr. 15, 2008

(54) DOCUMENT FEEDER AND IMAGE READING APPARATUS WITH THE SAME

(75) Inventors: Masaki Oomori, Yamanashi-ken (JP); Makoto Shimizu, Yamanashi-ken (JP); Toshihito Shiina, Yamanashi-ken (JP); Osamu Jinza, Yamanashi-ken (JP)

(73) Assignee: Nisca Corporation, Yamanashi-Ken (JP)

( * ) Notice: Subject to any disclaimer, the term of this patent is extended or adjusted under 35 U.S.C. 154(b) by 1007 days.

(21) Appl. No.: 10/786,085

(22) Filed: Feb. 26, 2004

(65) Prior Publication Data

US 2005/0006839 A1 Jan. 13, 2005

(30) Foreign Application Priority Data

Jul. 11, 2003 (JP) ..... 2003-273768
Jul. 11, 2003 (JP) ..... 2003-273770

(51) Int. Cl.
*H04N 1/04* (2006.01)
*H04N 1/21* (2006.01)
*G03G 15/00* (2006.01)

(52) U.S. Cl. ..... 358/498; 358/496; 358/296; 399/367

(58) Field of Classification Search ..... 358/498, 358/496, 296; 399/367, 379, 380
See application file for complete search history.

(56) References Cited

U.S. PATENT DOCUMENTS 5,428,424 A * 6/1995 Yoshida et al. ..... 399/367
6,057,936 A * 5/2000 Obara et al. ..... 358/296
6,388,775 B1 * 5/2002 Chiu ..... 358/474

FOREIGN PATENT DOCUMENTS

JP 62-126044 6/1987
JP 5-44655 7/1993

* cited by examiner

*Primary Examiner*—Houshang Safaipour
(74) *Attorney, Agent, or Firm*—Manabu Kanesaka

(57) ABSTRACT

A document feeder includes a frame to be disposed on a platen of a scanner; a sheet feeding stacker, a discharge stacker, and a transporting belt mounted on the frame; a lateral positioning member mounted on the frame for restricting the transporting belt laterally; and a vertical positioning member mounted on the frame for restricting the transportation belt vertically. The lateral positioning member is composed of a projection for abutting against a flange portion provided at a peripheral side of the platen to laterally restrict a position of the transporting belt. The vertical positioning member is composed of a projection for abutting against a surface of the platen to vertically restrict the position of the transporting belt.

20 Claims, 15 Drawing Sheets

DOCUMENT FEEDER AND IMAGE READING APPARATUS WITH THE SAME

BACKGROUND OF THE INVENTION AND RELATED ART STATEMENT

The present invention relates to a document feeder for feeding an original to an image reading platen in an image reading device such as a copy machine, a printer, a scanner, and a facsimile machine, and for storing the originals after reading the original. The present invention also relates to an image reading apparatus with the document feeder.

In general, there have been various feeding devices for automatically feeding and placing an original from a sheet feed stacker to an image reading platen in a scanner. A conventional feeding device is mounted on an upper portion of the platen of the image reading apparatus using a hinge so that the feeding device can be freely opened and closed. When the feeding device is not used for reading an original, an operator opens the feeding device to place the original on the platen manually and then covers the platen with the feeding device.

Recently, a copy machine, a scanner, and the like have been connected to a computer system in a network for reading images for a variety of purposes. For example, there has been a growing need for automatically feeding a special original, e.g., a photograph, negative film, and OHP (overhead projector) sheet, to a platen for reading with a feeding device. When a feeding device capable of feeding a special original including a photograph is integrally installed on a reading platen of a copying machine, scanner, and the like, it is difficult to automatically feed an original for other purpose, which is undesirable.

Japanese Patent Publication (Kokai) No. 62-126044 has disclosed a document feeder to be installed easily on a platen of a scanner device for a wide range of purposes when a user places a special original. Japanese Patent Publication (Kokoku) No. 05-44655 has disclosed a vacuum device for sucking and transporting an original such as a photograph that is easy to stick to a glass platen.

In the feeding device disclosed in Japanese Patent Publication (Kokai) No. 62-126044, an attachment is attached to the platen for positioning and the feeding device is placed on the platen using the attachment as a reference. Accordingly, it is necessary to precisely attach the attachment on the platen and mount the feeding device on the platen while holding the position properly.

In the vacuum device proposed in Japanese Patent Publication (Kokoku) No. 05-44655, it is necessary to precisely adjust a gap between a conveying belt and the platen so that the original is transported smoothly and a surface of the original is not damaged when transporting the original that is easy to stick to the platen.

In the device disclosed in the above patent reference, the following two references are set at the same place: an original setting reference for manually setting an original when the feeding device is not placed on the platen; and an original stopping reference for automatically stopping and setting an original in the feeding device. In this case, an image reading device such as a scanner reads the original in the same operation mode. On the other hand, in a feeding device, if the stopper for stopping the original is located at the manual setting reference, since the manual setting reference is located at an edge portion of the platen, light from a light source leaks outside, thereby deteriorating image quality. Accordingly, it is necessary to provide a light-blocking member for sealing between an exterior casing of the reading device and the feeding device around the platen.

In view of the problems described above, the present invention has been made, and an object of the invention is to provide a document feeder for automatically transporting a special original such as a photograph. The document feeder has a simple structure, and is easy to mount on a platen of a scanner.

Also, it is another object of the invention to provide a document feeder and an image reading device with the document feeder capable of correctly feeding and setting an original at a predetermined position on a platen. When the document feeder is installed on the platen, it is possible to position the device at precise vertical and lateral positions.

It is a further object of the invention to provide a document feeder and an image reading apparatus with the document feeder having the following advantages. When the document feeder is installed on the platen of the image reading device, it is possible to precisely position the document feeder and prevent leakage of light from and to outside upon light exposure on the original, thereby preventing deterioration of image quality. A position of a stopper for stopping the original can be adjusted according to a length of the original in a transporting direction. Accordingly, it is possible to minimize a transportation path of the original, whereby eliminating damage and transportation trouble.

SUMMARY OF THE INVENTION

In order to achieve the above objects, according to the present invention, a document feeder includes a frame to be disposed on a platen of a scanner; a sheet feeding stacker, a discharge stacker and a transporting belt mounted on the frame; a lateral positioning member mounted on the frame for restricting the transporting belt laterally; and a vertical positioning member mounted on the frame for restricting the transportation belt vertically. The lateral positioning member is composed of a projection for abutting against a flange portion of the platen provided at a peripheral side thereof to laterally restrict a position of the transporting belt. The vertical positioning member is composed of a projection for abutting against a surface of the platen to vertically restrict the position of the transporting belt.

According to the present invention, the frame is composed of a device (body) frame for covering an entire portion of the platen (maximum reading area), and a transporting case frame for covering a part (required reading area) of the platen. The device frame is provided with the lateral positioning member, and the transporting case frame is provided with the vertical positioning member. Accordingly, it is possible to make the position the document feeder compact for transporting a special original with a small size such as a photograph.

According to the present invention, the frame with the transporting belt may be provided with a transporting mechanism such as a vacuum device. The frame may be provided with the vertical positioning member for abutting against the platen surface to determine a vertical position. With this configuration, it is possible to properly arrange the transporting belt and vacuum device on the platen, thereby transporting the original reliably.

According to the present invention, the sheet feeding stacker, the discharge stacker and the transporting belt may be arranged substantially horizontally along the platen. The frame (device frame) with the sheet feeding and discharge stackers is provided with the lateral positioning member. The transporting case frame mounted to the device frame is provided with the vertical positioning member. Accordingly, it is possible to make the entire device on the platen compact.

According to the present invention, an original setting reference such as a step may be provided at a flange portion around the platen, and the device frame is installed on the platen. The transporting belt for transporting the original along the platen is mounted on the device frame. The device frame is provided with an original stopper for stopping the original, and positioning means for setting positions of the original stopper and the original setting reference. The original stopper is disposed at a location away from the original setting reference. Accordingly, the original transported by the transporting belt is stopped and set at a location closer to the center of the platen from an edge end portion thereof, thereby preventing deterioration of image quality due to leakage of light upon exposure.

According to the present invention, the original stopper may be movable to a plurality of locations according to a longitudinal size of the original on the platen. Accordingly, it is possible to minimize a transporting path, thereby reducing damage and transportation troubles. The image reading device performs several operation modes including an operation mode of starting to read from the original setting reference and an operation mode of starting to read from the original stopper position. Accordingly, it is possible to read an image from a proper location. The operation modes can be selected through input means, detecting means such as a sensor for detecting whether the transporting belt is located on the platen, or determining means for determining whether a control circuit of the transporting belt is electrically connected to a control circuit of photoelectric converting means.

According to the present invention, the document feeder is arranged to feed a small-size original including a photograph. The device frame covers the platen and is provided with the transporting case frame covering a part of the platen. The transporting case frame is provided with the transporting belt and the original stopper. The device frame is provided with an installing member for abutting against the original setting reference on the platen. Accordingly, the small document feeder is mounted on the platen, and the device frame covers the entire portion of the platen to prevent light leakage during exposure.

DETAILED DESCRIPTION OF PREFERRED EMBODIMENTS

Figure 1:
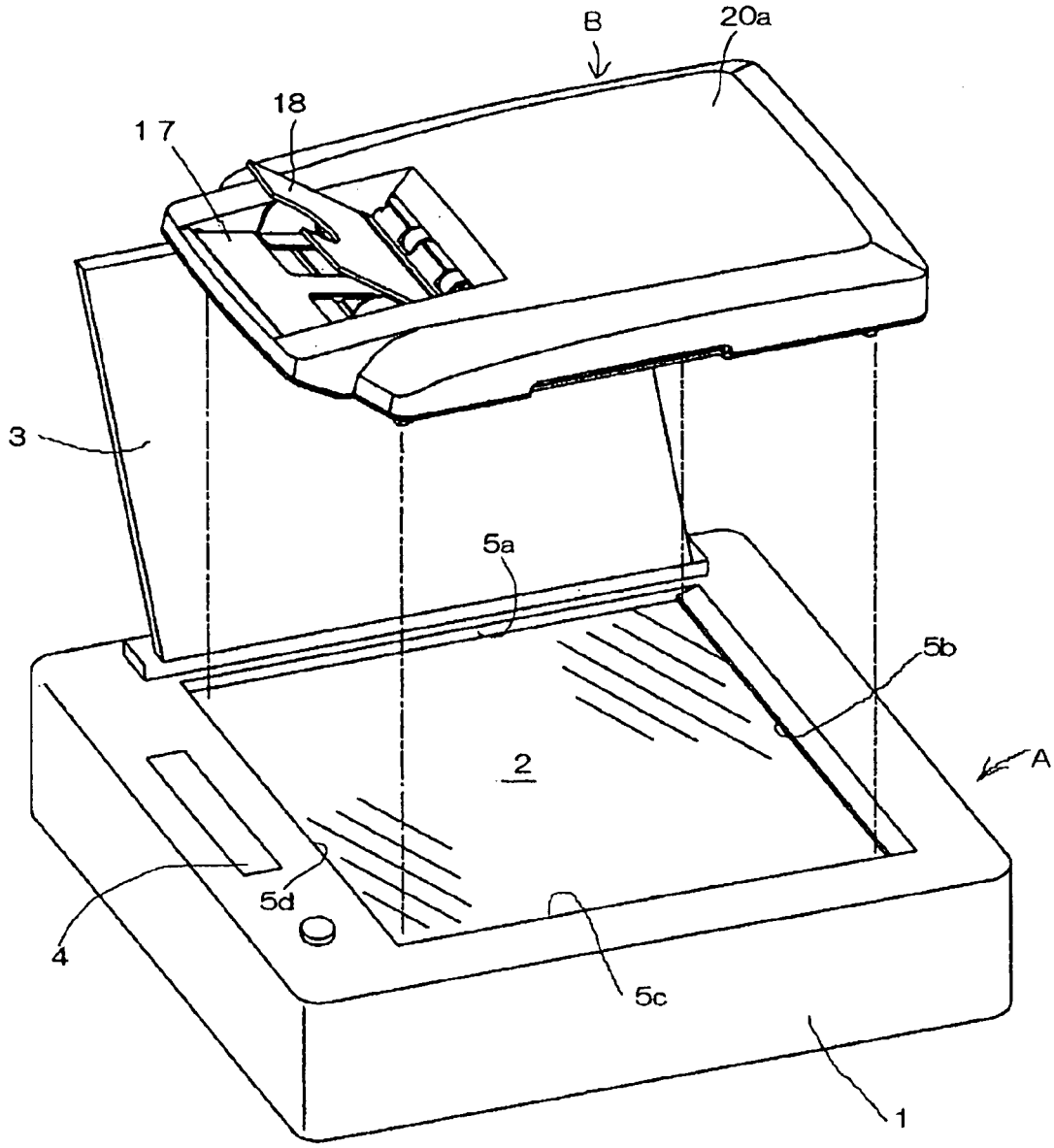
FIG. 1 is a perspective view showing a document feeder or feeding device placed on a scanner device.
Figure 2:
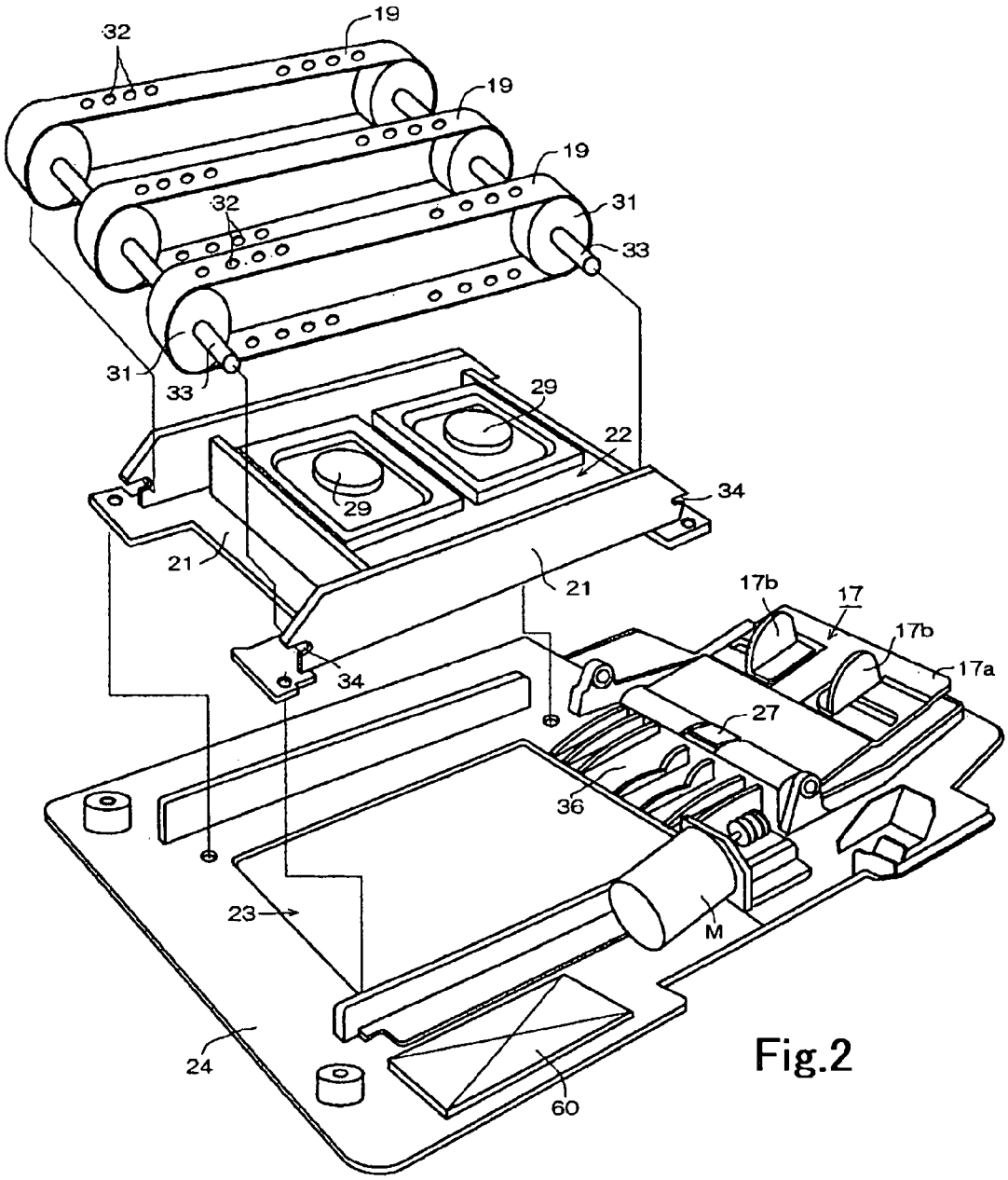
FIG. 2 is an exploded perspective view of the feeding device shown in FIG. 1.
Figure 3:
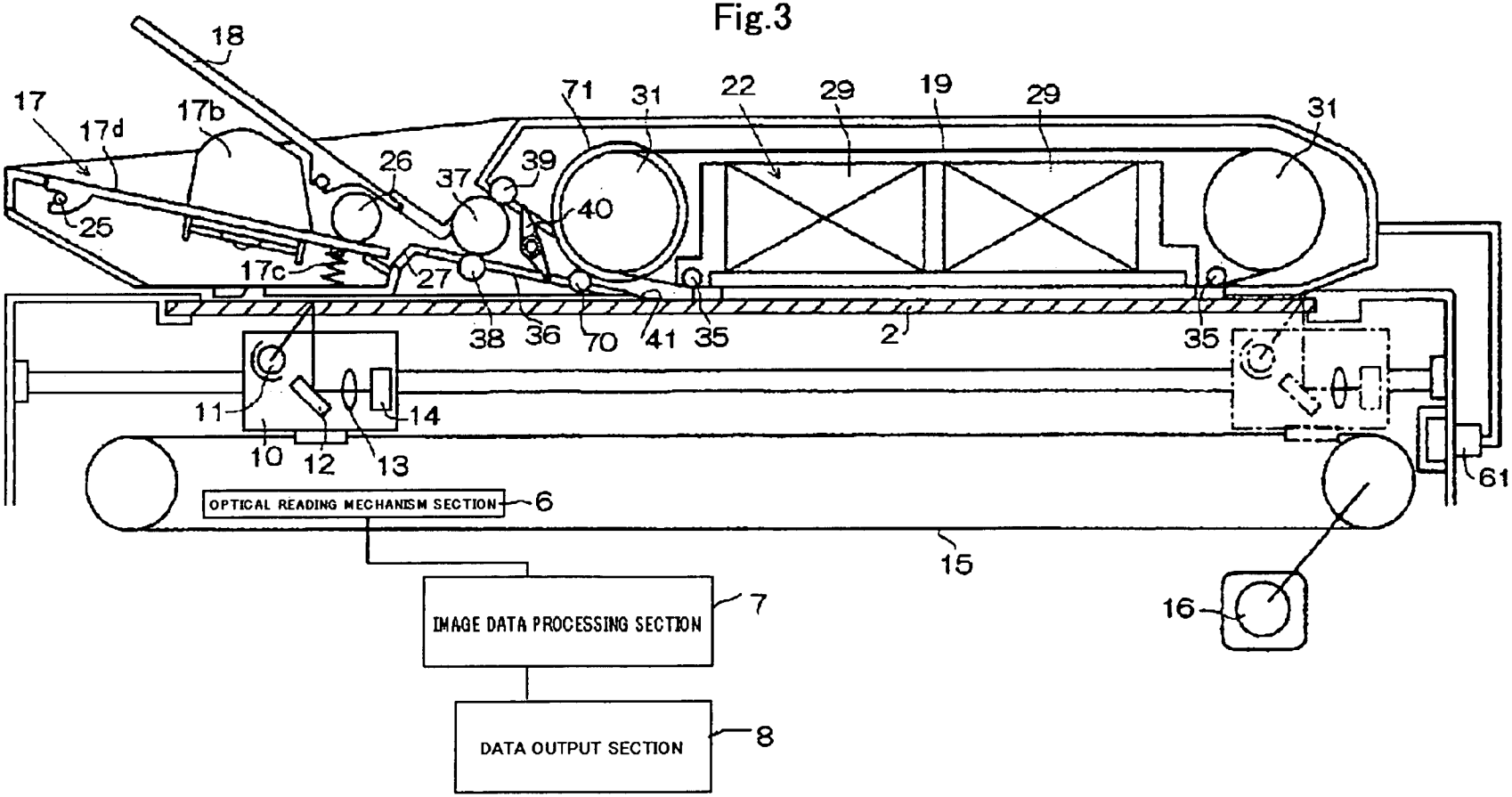
FIG. 3 is a section view of the feeding device shown in FIG. 2.
Figure 4:
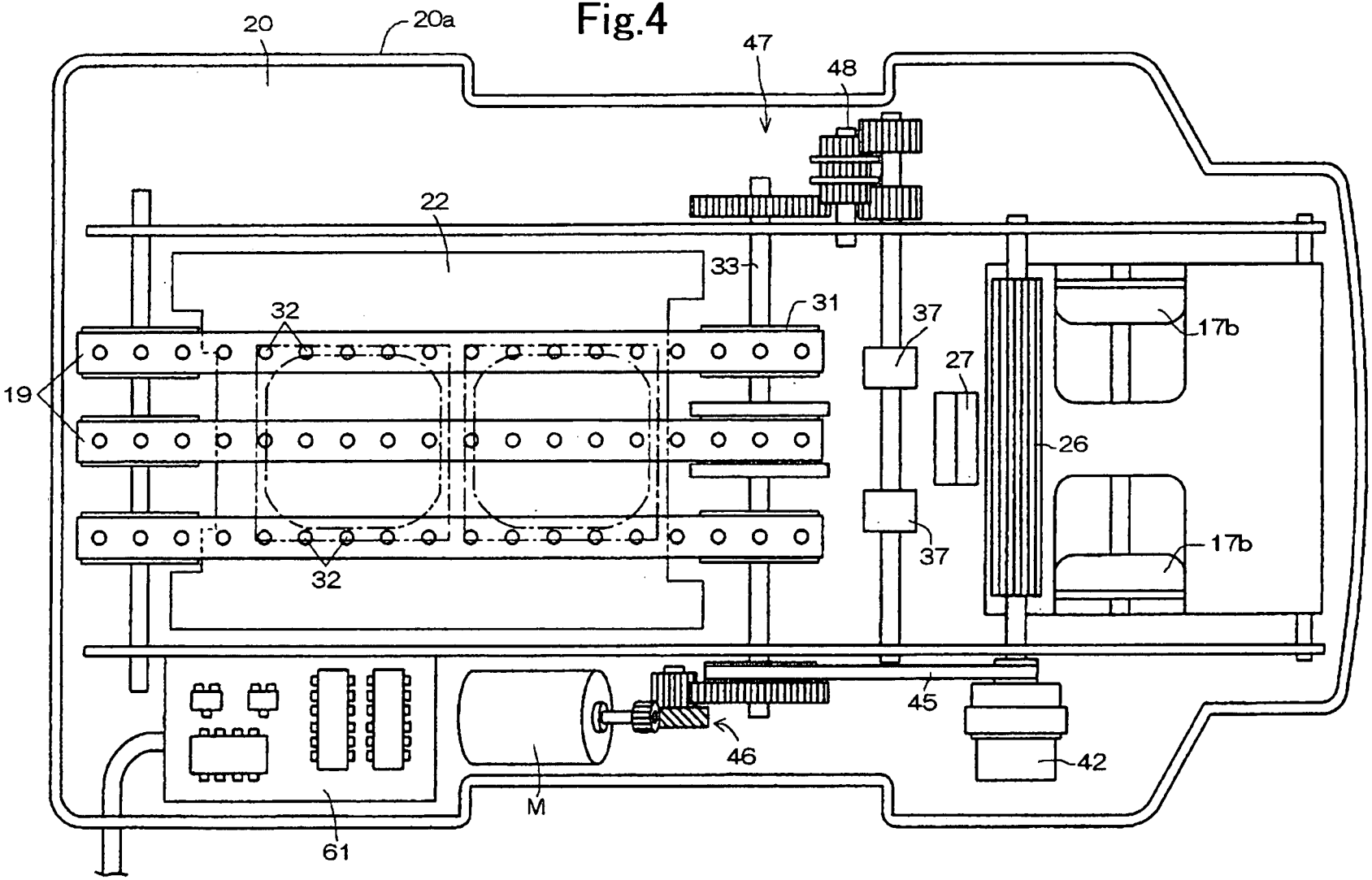
FIG. 4 is a plan view of the feeding device shown in FIG. 2.
Figure 5:
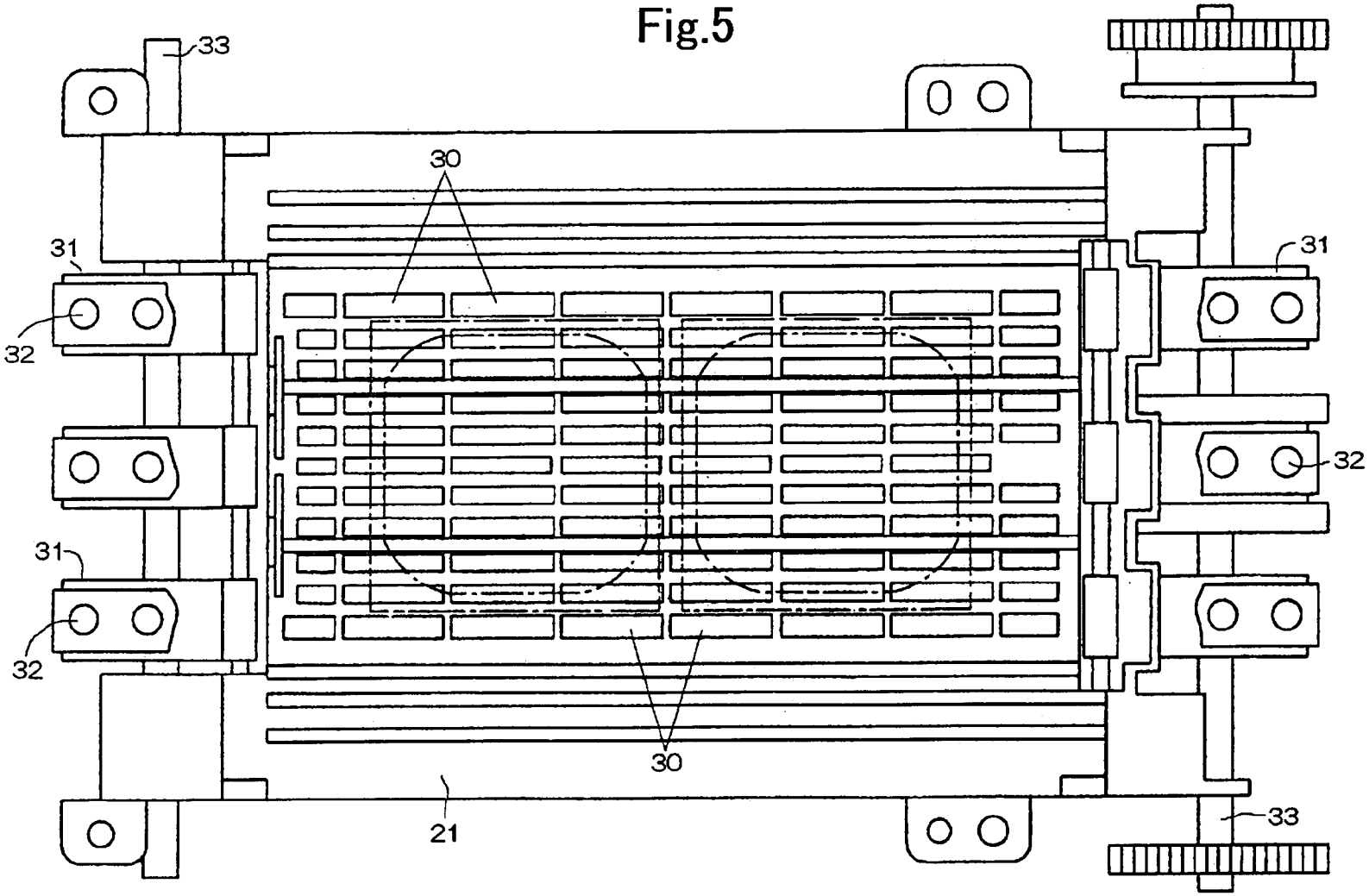
FIG. 5 is a bottom view of a transporting unit constituting the feeding device shown in FIG. 2.

Hereunder, embodiments of the present invention will be explained with reference to the accompanying drawings. FIG. 1 is a perspective view showing a document feeder mounted on a scanner device; FIG. 2 is an exploded perspective view of the feeding device shown in FIG. 1; FIG. 3 is a cross-sectional view of the feeding device shown in FIG. 2; FIG. 4 is a bottom view of the feeding device shown in FIG. 2; and FIG. 5 is a bottom view of a transporting unit constituting a part of the feeding device shown in FIG. 2.

As shown in FIG. 1, a feeding device B is installed above a platen 2 of an image reading apparatus A such as a scanner device. In the image reading apparatus A, the platen 2 is provided on a part of a casing 1. The platen 2 is formed of a transparent and flat glass plate so as to place an original on a top surface thereof.

The casing 1 is provided with a flange 5 having a step 5*a* for fixing the platen 2 and abutting against an original thereby to restrict a setting position of the original. A platen cover 3 is connected to the casing 1 with a hinge, so that the cover is arranged to open and close the top face of the platen 2. Inside the casing 1, there are provided an optical reading mechanism section 6, an image data processing section 7, a data output section 8, and a control section 9, as shown in FIG. 3. The optical reading mechanism section 6 has a carriage 10 movable along the platen 2. The carriage contains a light source 11, a reflecting mirror 12, an image-forming lens 13, and a photoelectric converter 14. The carriage 10 is reciprocated on a guide rail (not shown) in right and left directions in FIG. 3 by a driving wire 15 and a drive motor 16 mounted on the wire. Accordingly, the drive motor 16 is controlled to rotate to move the carriage 10 along the platen 2.

The photoelectric converter 14 contained in the carriage 10 is composed of a line sensor, e.g., CCD (Charge Coupled Device). The carriage 10 is arranged to irradiate light to the platen 2 from the light source 11, to guide the reflected light from the original set on the platen 2 to the image-forming lens 13 through the reflecting mirror 12, so that the image-forming lens 13 condenses the light on the photoelectric converter 14.

In the image data processing section 7, data from the photoelectric converter 14 is converted to a binary or multi-coded form through analog-to-digital (A/D) conversion, and corrected data correction including dither correction and gamma correction. The resultant data is stored in a storage element such as a frame buffer. The corrected data is output as an electric signal from the data output section 8 to an external computer or a printer device.

In regard to the structure of the above-described image reading apparatus, there have been known various structures as a general arrangement. Also, a flash exposure method has been well known, in which a plane sensor (area sensor) is used as the photoelectric converter to photoelectrically convert an entire original all at once without moving along the platen, and such a method can be applied to the embodiment of the invention.

Likewise, the carriage 10 may contain a contact-type sensor manufactured by integrating the photoelectric converter with a SELFOC lens. In the embodiment, a photoelectric converting mechanism is shown in which an image is formed on the CCD through the reducing optical system with the image-forming lens.

It is common in the ordinary scanner devices and copying machines that a user sets an original on the platen 2 and covers the platen 2 with the platen cover 3, and then pushes an operation button for reading an image on the original. Instead of the platen cover 3, an automatic document feeder (ADF) for automatically feeding the original may be mounted. The ADF device has been widely used and known. The ADF device has a sheet feed stacker and a discharge stacker arranged in line vertically, and a U-shaped transporting path is provided between the sheet feed stacker and the discharge stacker, so that the platen faces the transporting path at a midway along the path. Accordingly, the originals can be sequentially read while passing at a constant speed while the carriage 10 is stopped. The ADF device may be rotatably installed on the platen 2 like the platen cover 3, and the top face of the platen 2 can be uncovered.

The feeding device B installed on the platen 2 includes a sheet feed stacker 17 on which an original is placed; a discharge stacker 18; and transport belts 19 for transporting the original from the sheet feed stacker 17 to the discharge stacker 18, all of which are mounted on a device frame 20. The feeding device may be provided with the following features for feeding a silver-silver chloride photograph and the like. However, the invention is not necessarily limited to the feeder for silver-silver chloride photographs.

In general, a surface of the silver-silver chloride photograph is coated with a gelatin like substance. Therefore, when the photograph is transported while pressing against a glass platen, it is possible to cause a feeding trouble or damage on the surface of the photograph. In order to solve this problem, the transport belts 19 are disposed away from the surface of the platen to form a small space therebetween, and a vacuum chamber 22 is provided for sucking the photograph.

The sheet feed stacker 17 and transport belts 19 are aligned along the surface of the platen so that the original fed from the sheet feed stacker is sucked to the transport belt by a negative pressure in the vacuum chamber. In addition, a slope angle of a transporting guide located between the sheet feed stacker and the transport belt is determined so that the original is brought into close contact with the belt. Further, the transport belts 19 are installed with an inclination to the surface of the platen. A distance between the belts and the platen surface is determined based on experiments, so that the distance is larger than the thickness of the originals. The vacuum chamber 22 has a configuration described later.

A size of the photograph is smaller than that of a regular platen, e.g. A3 size in accordance with the Japanese Industrial Standards (JIS). When the feeding device has a same size as the platen, the device becomes large and heavy, thereby making it difficult to handle. According to the embodiment, a transporting case frame 21 (second frame) is formed separately from the device frame 20 (first frame) covering the entire platen, and covers a part of the platen required for transporting the original. Components for transporting the original such as the transport belts 19 and vacuum chamber 22 are disposed in the transporting case frame 21, so that the feeding device has a small size and lightweight. The device frame 20 is provided with a light-shielding cover member 24 for covering a platen surface area except a portion the transporting case frame 21 covers.

The device frame 20 is composed of an exterior cover 20*a* shown in FIG. 1 and a bottom frame 20*b* shown in FIG. 4, each formed of a synthetic resin and combined to form a housing for the entire device. The device frame 20 has a unitized structure, on which the sheet feed stacker 17, discharge stacker 18, transporting case frame 21, and a drive motor M (described later) are mounted.

The device frame 20 has a size to cover the entire platen 2 of the image reading apparatus A. The bottom frame 20*b* is provided with the exposure opening 23 for mounting the transporting case frame 21, and the light-shielding portion (light-shielding member) 24 for covering a portion of the platen 2 except a region corresponding to the opening 23.

The device frame 20 has a size larger than the platen 2, and the bottom frame 20*b* thereof is provided with the light-shielding portion (light-shielding member) 24, so that light from the light source 11 does not leak to the outside. The light-shielding portion (light-shielding member) 24 has a plate form and abuts against the platen 2.

The sheet feed stacker 17 and discharge stacker 18 are mounted to the bottom frame 20*b*. The sheet feed stacker 17 is provided with a pair of right and left side guides 17*b*, and rotatably fixed by pin 25 of the bottom frame 20*b* of the device with a angle so that the originals can fall down by gravity. The side guides 17*b* are mounted on the original-placing stacker 17*a* and are arranged to approach and separate from each other by the same distance for aligning the center of the originals of different sizes with the reference (center reference). Such a structure has been widely known as the rack and pinion combination, wires, etc.

At a forward end of the sheet feed stacker 17, a paper feed roller 26 is disposed so as to draw out an uppermost original on the stacker rightward in FIG. 3. A friction pad 27 is disposed in front of the roller 26. The paper feed roller 26 and friction pad 27 are made of a material with enough friction coefficient for separating the originals one by one, and their manufacturing conditions have been widely known. In the embodiment, a handle-and-separate structure, in which the originals are separated one by one when an end of the original pulled out by the paper feed roller 26 passes on the friction pad 27, is adopted to prevent the original from being damaged. The paper feed roller 26 and friction pad 27 are individually mounted on the bottom frame 20*b* of the device frame 20.

An urging spring 17*c* constantly presses the sheet feed stacker 17 against the paper feed roller 26. The discharge stacker 18 is disposed in parallel to the sheet feed stacker 17, and is mounted on the bottom frame 20*b* of the device frame 20. The sheet feed stacker 17 and discharge stacker 18 are arranged in line vertically so that the entire feeding device B is mounted on the platen 2 in a compact size.

As shown in FIGS. 2 and 5, the transporting case frame 21 is mounted at the exposure opening 23 of the device frame 20. The transporting case frame 21 has a vacuum chamber 22 integrally formed of a resin. The chamber 22 is provided with a vacuum fan 29, and the transport belts 19 are placed around the chamber. The transport belts 19 are composed of endless belts supported by a pair of pulleys 31, and have air holes 32 bored along its entire length. The rotational shafts 33 of the pulleys 31 are fitted in bearing grooves 34 formed in the transporting case frame 21 and rotatably supported. The transporting case frame 21 is provided many vacuum through holes 30, so that the transport belts 19 transport the original while the original is sucked to the belt.

Figure 6:
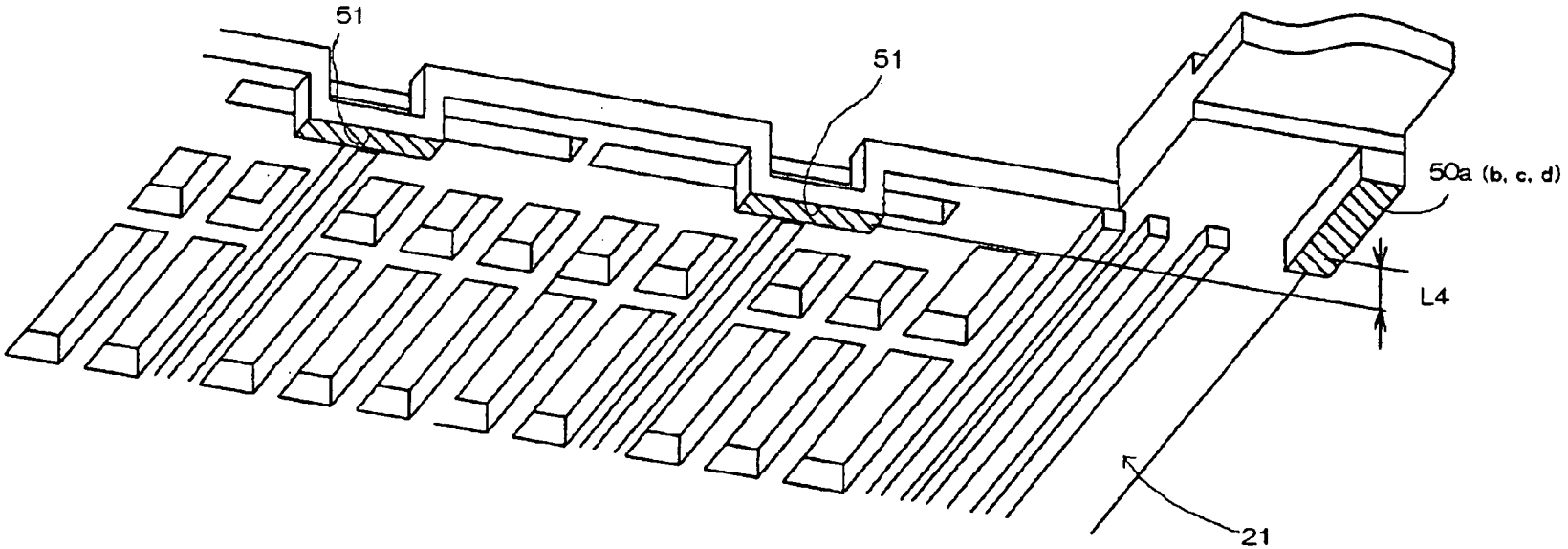
FIG. 6 is a perspective view of an original stopper of the feeding device shown in FIG. 2.

As shown in FIG. 6, the transporting case frame 21 is provided with original stoppers 51 formed of projections disposed between the transport belts 19. The original stoppers 51 are integrated with the bottom frame 20*b* and have a height larger than that of vertical positioning members 50 (described later) by L4. The stoppers 51 have a shape easy to deform elastically to the same height as the vertical positioning member 50 when the device is mounted on the platen 2. Accordingly, the original stopper 51 can closely contact the platen 2 to stop the originals reliably.

Reference numeral 35 shown in FIG. 3 denotes a pair of right and left tension rollers disposed on one side of the transport belts 19 facing the platen 2 and radially inside the periphery of the transport belts for controlling the belt at a predetermined height so that the transport belts rotate smoothly.

A transporting guide 36 integrated with the transporting case frame 21 is disposed between the sheet feed stacker 17 and transport belts 19 for guiding the original from the sheet feed stacker 17 to the transport belts 19 and from the transport belts 19 to the discharge stacker 18. The transporting guide 36 is provided with a transporting roller 37 rotating counterclockwise in FIG. 3. A pinch roller 38 is disposed at a side of the roller 37 facing the sheet feed stacker 17, and a pinch roller 39 is disposed at a side of the roller 37 facing the discharge stacker 18. A drive mechanism (described later) drives the transporting roller 37 to draw the original toward the transport belts 19 on the feeding side and to eject the original on the discharge side, thereby making the device compact and simple.

Reference numeral 40 denotes a path-switching gate provided in the transporting guide 36. Reference numeral 41 denotes a pick-up guide made of a plastic film. The switching gate 40 has a weight such that, in the state shown in FIG. 3, the original from the sheet feed stacker 17 lifts the gate with the forward end thereof to move in the right direction, and the original moving from the platen in the left direction is guided to the discharge stacker 18. The pick-up guide 41 is formed of an elastic film, and picks up the original moving in the left direction and guides the original to the switching gate 40.

In drive mechanism, as shown in FIG. 4, the device frame 20 is mounted with the drive motor M capable of rotating in forward and reverse directions. The drive motor M rotates in forward and reverse directions to rotate the paper feed roller 26, transport belts 19, and transporting roller 37. The paper feed roller 26 is connected to the drive motor M through an electromagnetic clutch 42 using a driving belt 45 and a driving gear 46. The transport belts 19 are connected to the drive motor M using the driving gear 46 and also connected to the transporting roller 37 through a driving gear 47.

The driving gear 47 has a one-way clutch therein. When the drive motor M rotates in one direction, the driving force is transferred to the rotational shaft of the transporting roller 37, but the rotation in the opposite direction is not transferred. The rotation of the drive motor M in the opposite direction is changed in its rotational direction with the mid gear 48, and then transferred to the rotational shaft of the transporting roller 37.

As a result, the forward and reverse rotations of the drive motor M are transferred to the transport belts 19 as forward and reverse rotations. Also, the forward and reverse rotations are transferred to the transporting roller 37 as rotation in a single direction, i.e. counterclockwise direction in FIG. 3, all the time regardless of the rotational direction of the drive motor M. Reference numeral 60 denotes a control circuit board in the feeding device for supplying power to the drive motor M and controlling ON and OFF of the electromagnetic clutch 42.

The feeding device B is mounted on the top face of the platen 2 of the image reading device A as follows. The platen 2 is provided with steps 5*a*, 5*b*, 5*c*, and 5*d* between a flange 5 provided on the casing 1, and the steps 5*a* and 5*b* at two adjacent sides are used as a reference for setting the original.

The feeding device B is positioned with respect to the image reading device A using lateral positioning members 49 abutting against the steps 5*a* and 5*b* as the original-setting reference and vertical positioning members 50 abutting against the surface of the platen, so that the feeding device B is installed on the reading device A.

The lateral positioning members 49 determine the positions of the original stopper 51 and the original setting reference. The lateral positioning members 49 include projections 49*a*, 49*b*, 49*c*, and 49*d*, formed on the light-shielding portion (light-shielding member) 24 of the bottom frame 20*b* of the device frame 20. The lateral positioning members 49 are arranged to abut against the steps 5*a* and 5*b* of the flange 5 used as the original setting reference of the image reading device A, thereby to set a position shown in FIG. 7.

Figure 7:
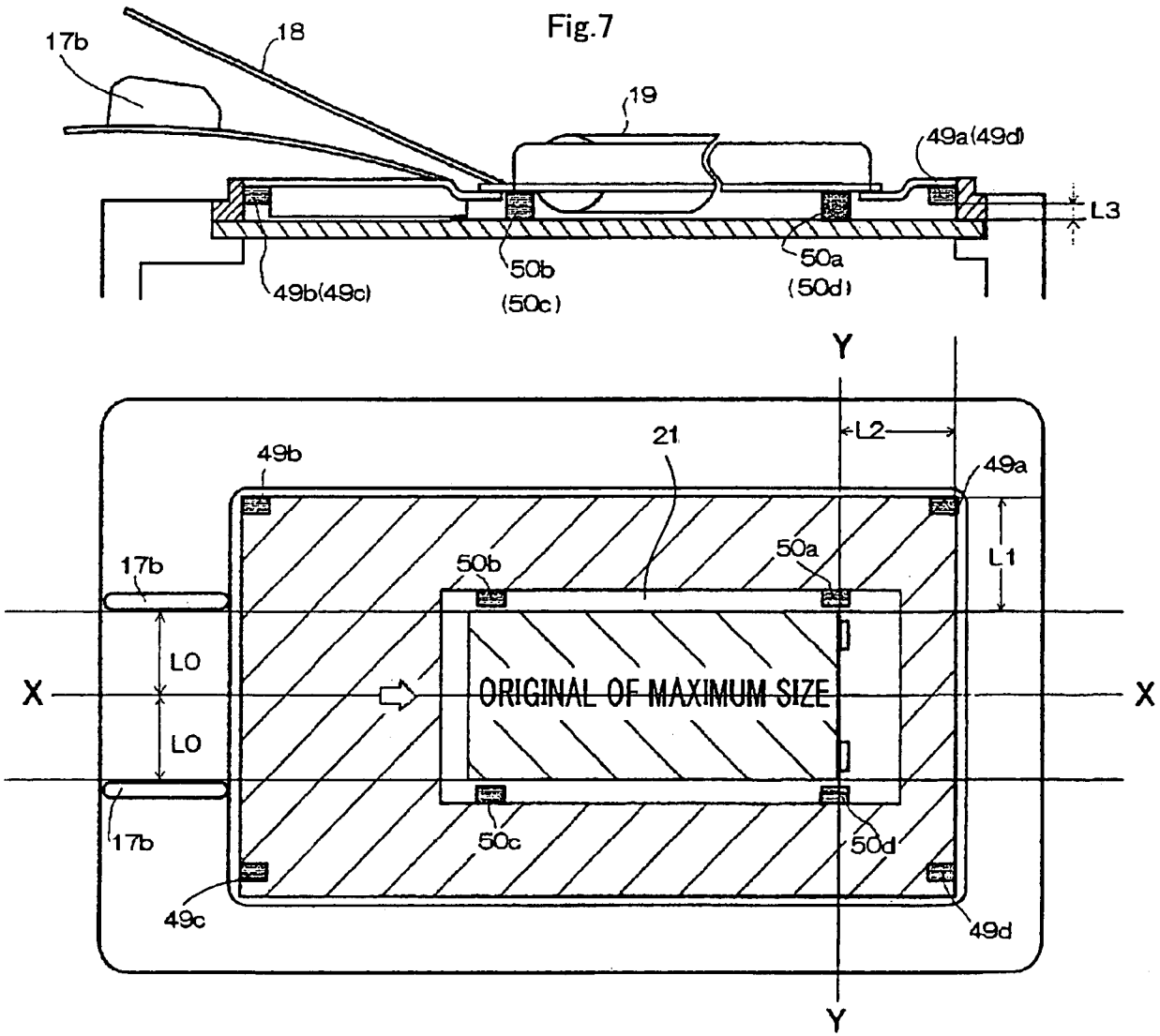
FIG. 7 is a view showing a geometric relation among a platen of the feeding device shown in FIG. 2, lateral positioning members, and vertical positioning members.

As shown in FIG. 7, when the side guides 17*b* of the sheet feeding stacker 17 are positioned with center reference, the center line X-X of the side guides 17*b* is positioned away from the reference steps 5*a* by a distance of L1 in parallel. The line Y-Y of the original stoppers 51 perpendicular to the line X-X is located away from the reference step 5*b* by a distance of L2 in parallel.

The lateral positioning members 49, in order to establish such alignment condition, may include projections abutting against one position of the reference steps 5*a* and one position of the reference steps 5*b*. It is preferable to provide three projections in order to allow a user to perform the positioning easily. When the sheet feeding stacker 17 is set with a single side reference, a reference line for original transportation may be located away from the reference steps by a predetermined distance in parallel.

The vertical positioning members 50 are provided on the transporting case frame 21. As shown in FIG. 7, projections 50*a*, 50*b*, 50*c*, and 50*d* are provided on a bottom of the transporting case frame 21 at four corners outside the original-transporting region, and a gap L3 is formed between the vacuum chamber 22 shown in FIG. 7 and the platen surface. Accordingly, the lateral positioning members 49 and vertical positioning members 50 are formed to have heights of the projections so that only the vertical positioning members 50 abut against the platen surface, whereas the lateral positioning member 49 does not contact the surface (see FIG. 7). It is difficult to produce all the projections to have the same height (length). With this configuration, it is possible to prevent a situation that the lateral positioning members 49 abut against the platen surface and the vertical positioning members 50 do not.

Figure 10A:
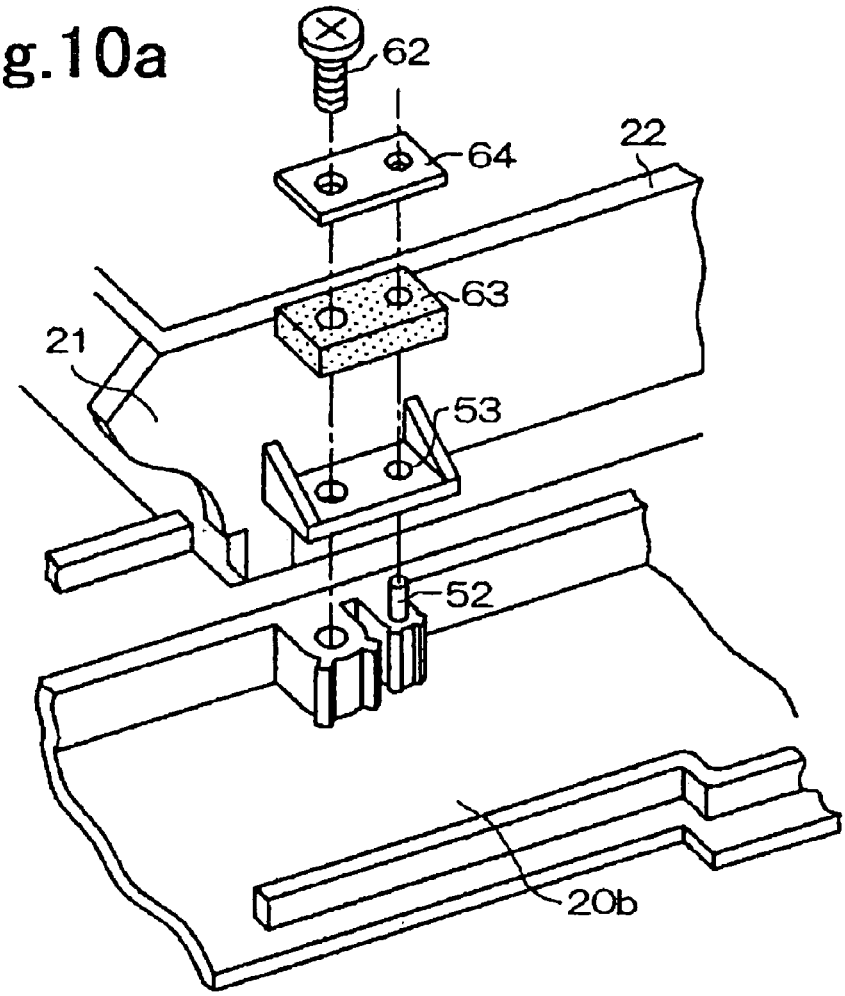
FIGS. 10*a* and 10*b* are views showing a modified mounting structure of a device frame and a transporting case frame in the feeding device shown in FIG. 2.

The lateral positioning member 49 and vertical positioning member 50 may be constructed such that the device frame 20 and transporting case frame 21 can be vertically movable relative to each other as shown in FIG. 10*a*. In this case, a proper number, i.e. preferably three or four, of stud-type fixing pins 52 are provided in the bottom frame 20*b* of the device frame 20. The transporting case frame 21 is provided with engagement holes 53 for fitting the fixing pins 52. The transporting case frame 21 is vertically movable along the fixing pins 52 with respect to the device frame 20, and the frames are secured with collar screws 61 so as not to come out.

With such arrangement, the transporting case frame 21 is installed with a predetermined space formed between the case frame 21 and the platen surface with the vertical positioning members 50. The device frame 20 is installed on the platen surface with the lateral positioning members 49, so that the light-shielding portion (light-shielding member) 24 covers the surface of the platen 2. A cushion member 63, more specifically a washer, is provided so that the device frame 20 and transporting case frame 21 move smoothly.

Figure 10B:
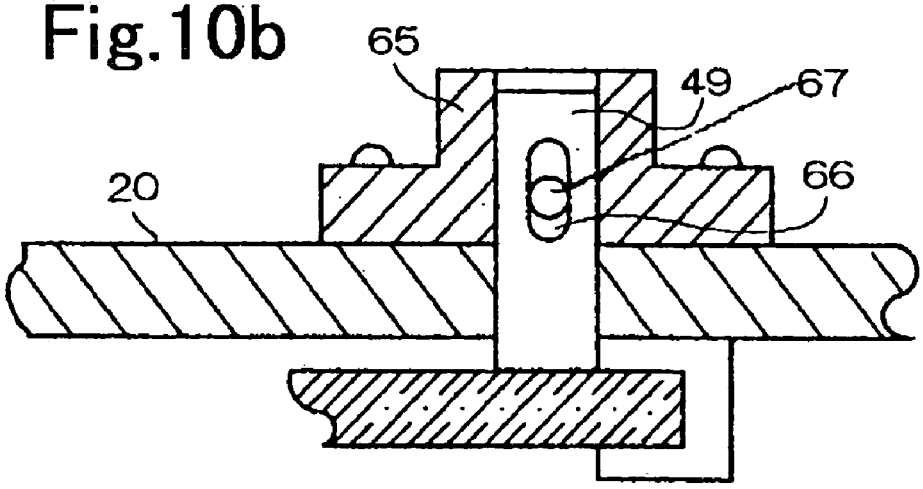

Modified embodiments of the lateral positioning member 49 and vertical positioning member 50 are shown in FIG. 10*b*. Three or four cylindrical holders 65 are integrally formed with the bottom frame 20*b* of the device frame 20. Projections 49*a*, 49*b*, 49*c*, and 49*d* are fit into the holders 65. The slits 66 and pins 67 are vertically movable within a predetermined height to move up and down the lateral positioning members 49 following the platen surface.

With the above arrangement, the device frame 20 with the transporting case frame 21 mounted thereto is restricted in lateral position by the lateral positioning members 49 (projections 49*a*, 49*b*, and 49*c* in the drawing), and in vertical position by the vertical positioning member 50 (projections 50*a*, 50*b*, 50*c*, and 50*d*).

A configuration of the original stoppers 51 will be explained next. The original stoppers 51 are provided at a location along the line Y-Y shown in FIG. 7 in the transporting case frame 21, and are arranged away from the original setting reference by a distance of L2. The original stoppers 51 are disposed at two or more positions in a direction (sub-scan direction) that the carriage 10 moves.

Figure 12A:
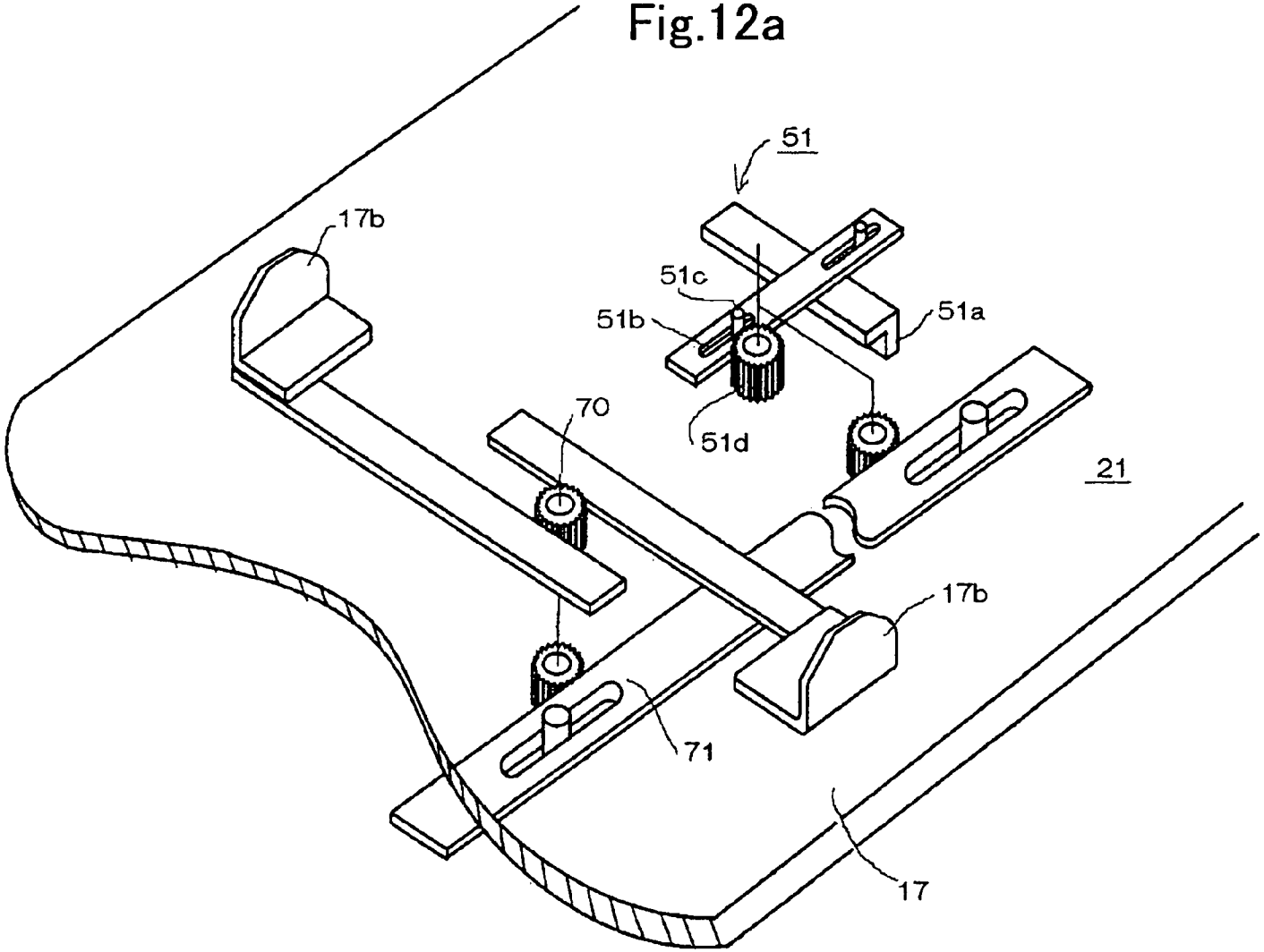
FIG. 12*a* is a view showing a structure of the original stopper of the feeding device shown in FIG. 2.
Figure 12B:
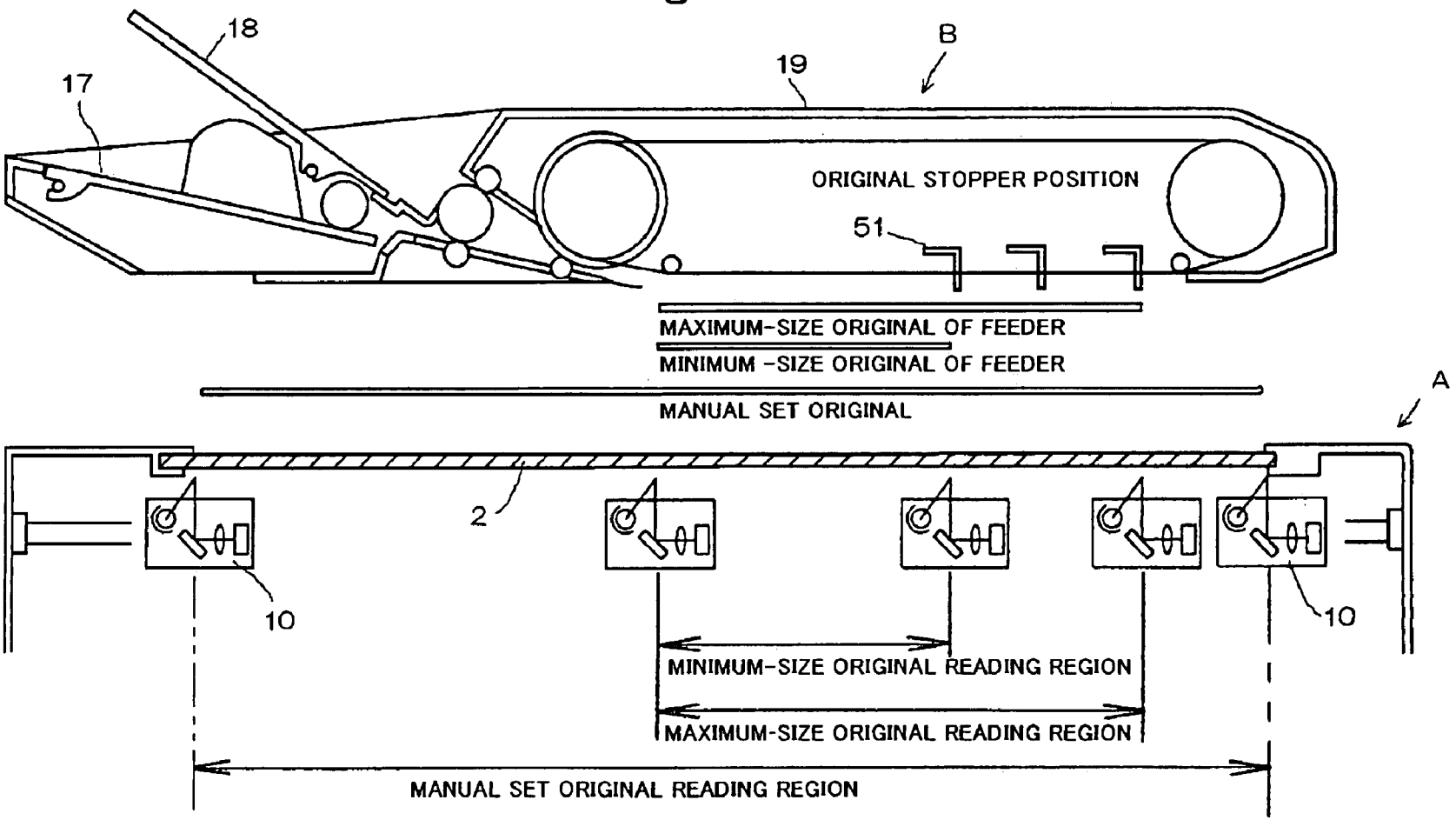
FIG. 12*b* is a view showing image scanning regions of the feeding device shown in FIG. 2.

A structure of the original stopper is shown in FIGS. 12*a* and 12*b*. A stopper piece 51*a* is mounted slidably in the original transporting direction in the vacuum chamber 22 in the transporting case frame 21. The stopper piece 51*a* is slidably supported by fitting a pin embedded in the vacuum chamber 22 in a slit 51*b*. The original stopper further includes a rack 51*c*. The rack 51*c* engages a pinion 51*d*, and the pinion 51*d* interconnects with the side edge guide 17*b* of the sheet feeding stacker 17.

As described above, the edge guide 17*b* is composed of a pair of right and left guide plates. A rack-and-pinion mechanism 70 moves the guide plates closer to and away from each other for a same distance. The rack-and-pinion mechanism 70 and is connected to the pinion 51*d* through a transmission mechanism 71. The transmission mechanism 71 may be one of various types.

When the edge guides 17*b* move to align with the side edge of the original on the sheet feeding stacker 17, the stopper piece 51*a* moves. When that original has the maximum size, the stopper piece 51*a* in the transmission mechanism 71 is located a position along the line Y-Y shown in FIG. 7. The stopper piece 51*a* moves toward at an upstream side of the original transporting direction as a width size of the original decreases. Accordingly, the original is stopped at the positions on the platen away from the sheet feeding stacker according to the original size, i.e. a small size, middle size, and large size in order.

As a result, it is possible to reduce damage on the original as the original is transported in the shortest distance. An original size detecting sensor may be provided on the sheet feeding stacker 17, so that the original stoppers 51 can move for a predetermined distance in response to a signal from the sensor.

Figure 11:
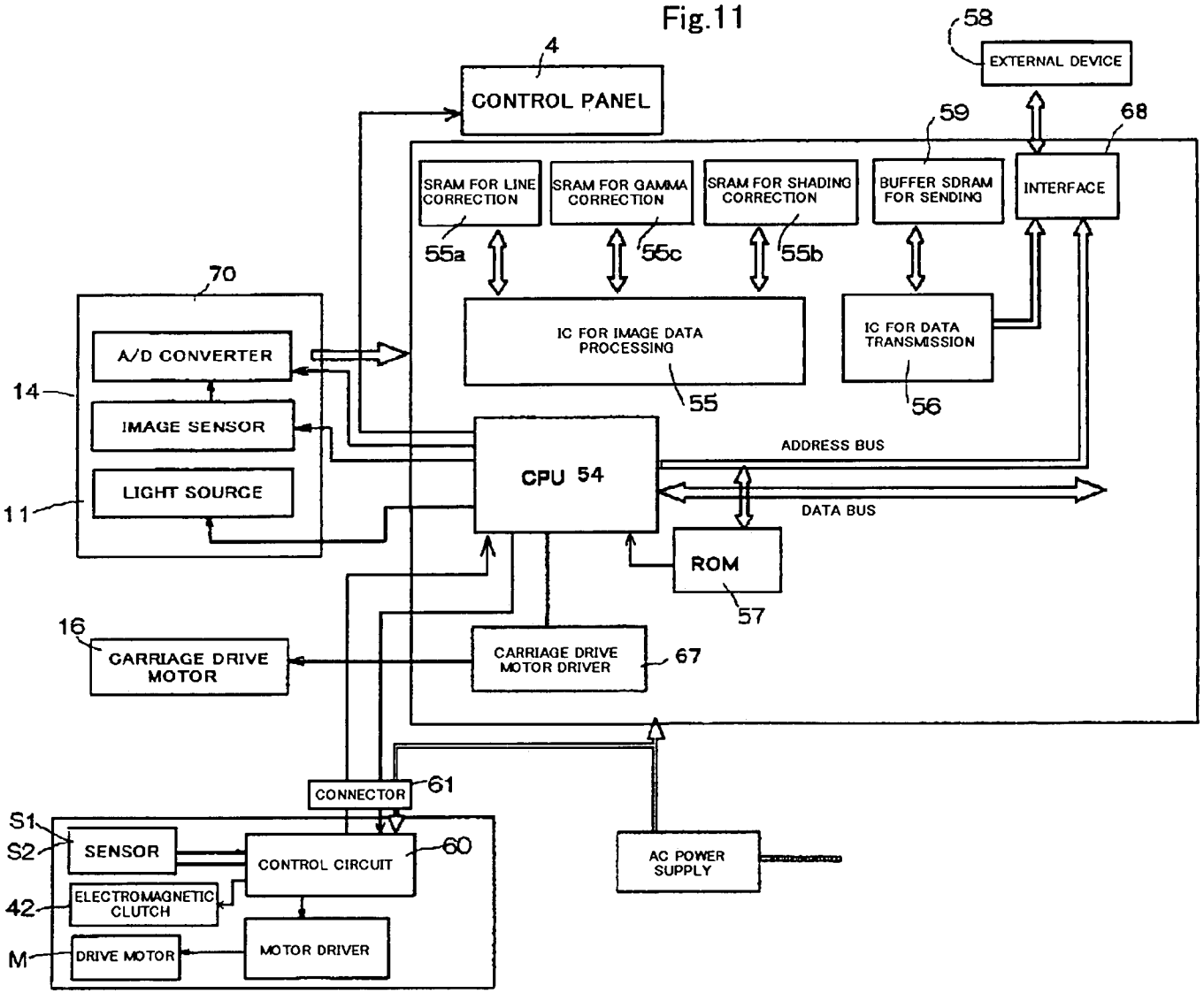
FIG. 11 is a block diagram showing a control section of the image reading device and the control circuit of the feeding device.

With reference to FIG. 11, a control of the image reading apparatus and feeding device will be described. First, as a generally known arrangement, the image reading apparatus A reads the original put on the platen 2, the image data processing section 7 performs image processing, and the resultant data is transmitted from the data output section 8 to a computer, printer, etc. Then, the control section controls the optical reading mechanism 6 shown in FIG. 11. The image reading apparatus A has a built-in control board having a CPU 54, an image-processing IC 55, and an output data processing IC 56 incorporated therein.

Figure 8:
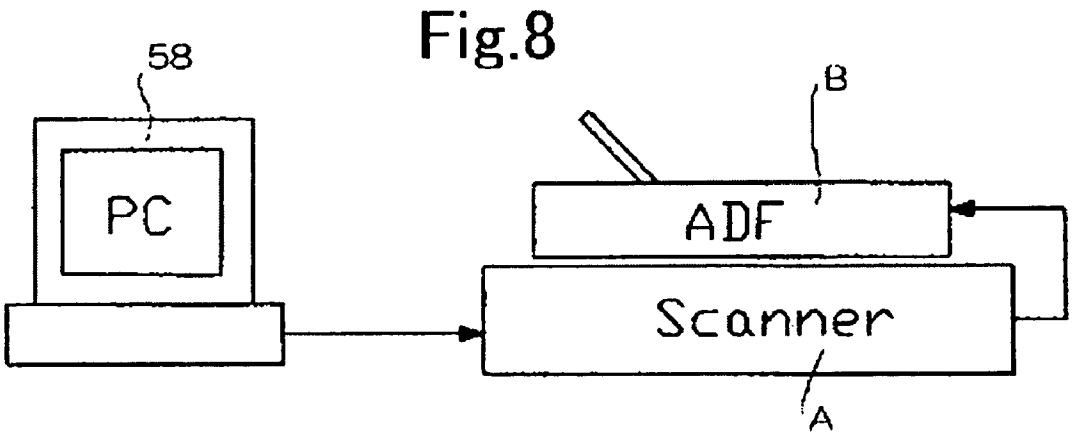
FIG. 8 is a schematic view showing a state that an external device, image reading apparatus, and feeding device are connected.
Figure 9:
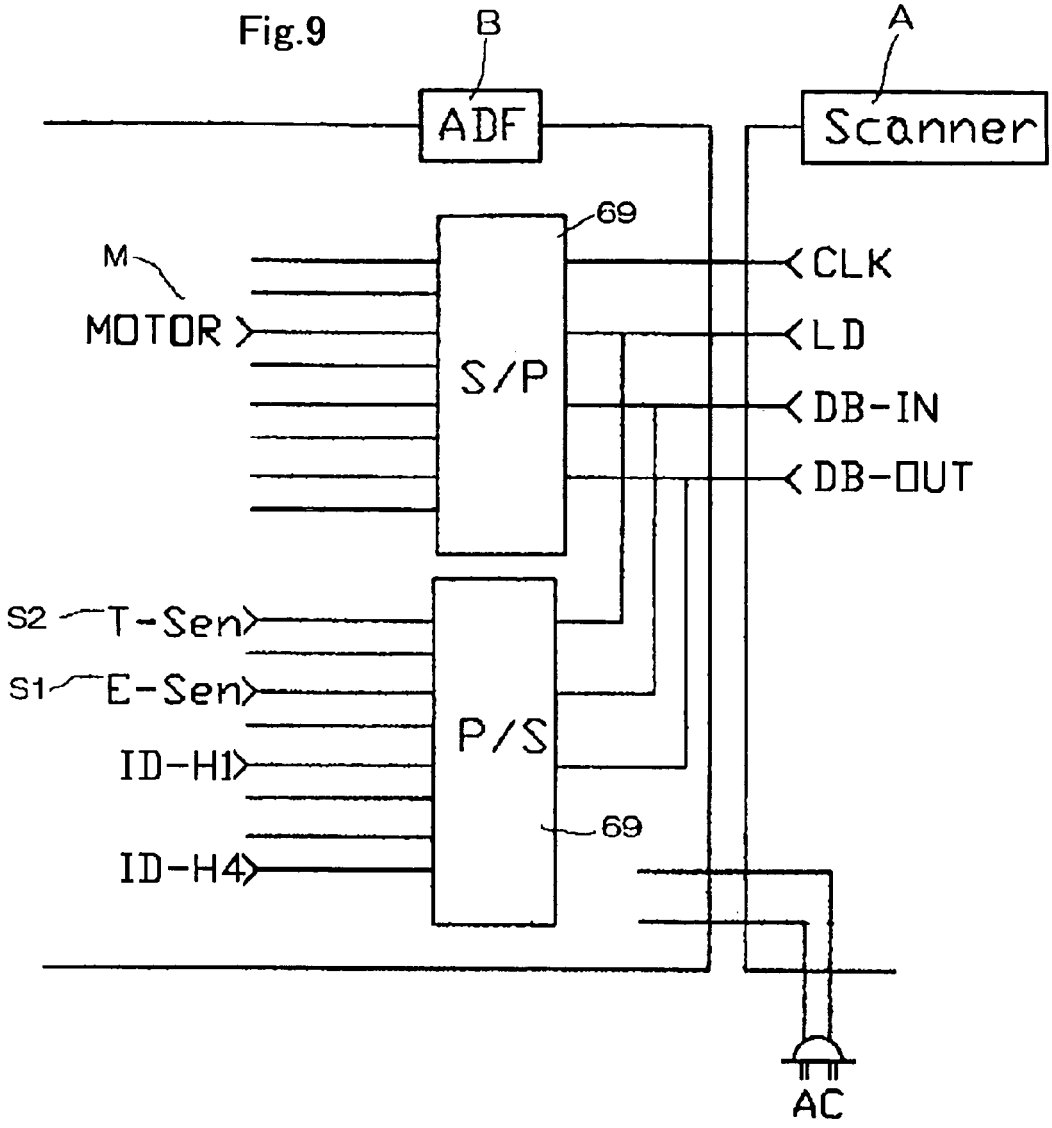
FIG. 9 is a view showing a control circuit of the feeding device.

The central processing unit CPU 54 is composed of a processor for executing a control program of the ROM 57. The image-processing IC 55 is connected to an SRAM 55*a* for inter-line correction, an SRAM 55*b* for gamma correction, and an SRAM 55*c* for shading correction. The output data processing IC 56 is connected to a buffer SDRAM 59 and an interface 68 for sending data to an external device 58 such as a computer. The CPU 54 is connected to a driver 67 of the carriage drive motor 16, a light source 11, and a control circuit 70 of the photoelectric converter 14. The CPU 54 and the control circuit 60 of the feeding device communicate mutually to receive and transmit signals as shown in FIG. 8.

The control circuit 60 of the feeding device B is arranged so that signals in the control section 9 are transmitted to the drive motor M of the feeding device B and the driver circuit of the electromagnetic clutch 42 through the control section 9 and a serial-to-parallel converter means 69, and signals of sensors S1 and S2 (described later) are transmitted from the feeding device B to the control section 9.

The feeding device B is provided with an empty sensor S1 for detecting the original on the sheet feed stacker 17, and a jam sensor S2 for determining whether the original is accumulated at the discharge port of the discharge stacker 18 longer than a predetermined time and no original reaches the discharge port for a period of time longer a predetermined time. Signals detected by these sensors are sent to the feeder control circuit 60. The control section 9 of the image reading apparatus A and the feeder control circuit 60 are connected through a connector 61 with each other and communicate mutually to receive and transmit signals. The image reading apparatus A is arranged to supply power for the drive motor M to the feeding device.

In the image reading apparatus A, it is possible to select a reading mode through the control panel thereby to perform various operations including changing a regular operation mode, changing a scanning speed of the carriage 10 according to image types, e.g., color, monochrome, and gray scale, resolution, etc.

It is necessary to change the operation mode depending on whether the feeding device B is installed on the platen 2 or not. In the embodiment, a setting position is different by L1 and L2 as shown in FIG. 7, that is, the original fed by the feeding device varies is placed at a reading position different by L1 in a main scan direction and L2 in the sub-scan direction. Therefore, it is determined whether the connector 61 is connected, and when the connector is not connected, the reading operation is carried out in the regular operation mode, otherwise the following operations will be carried out.

Various methods can be adopted to determine whether the feeding device is mounted. In the first method, a user operates buttons of an input device provided on the control panel 4, known as a key input method. In the second method, optional detecting means, i.e. a sensor, is provided for determining whether a feeding device, i.e. the transporting belts 19, are on the platen 2. The detecting means may include a photo-sensor for detecting the transporting case frame 21 on the platen 2, or the photoelectric converter 14 for reading an image. In the case of the photoelectric converter, the detection is performed when the carriage 10 with the photoelectric converter 14 is initialized, thereby making the configuration simple. In the embodiment, it is determined whether the connector 61 is connected (described later).

Figure 13:
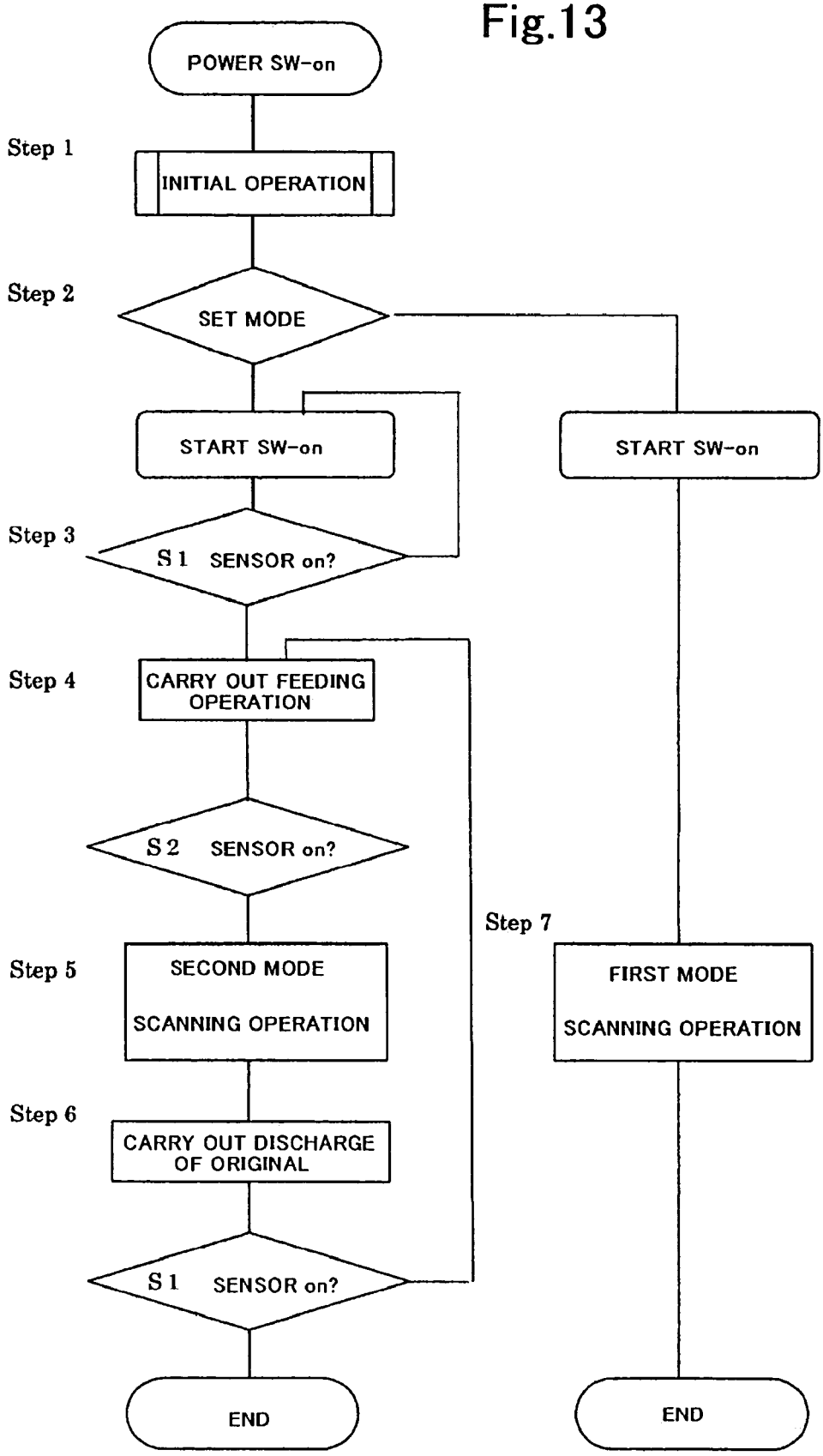
FIG. 13 is a flowchart for explaining an operation of the image reading device with the feeding device mounted thereon.

An operation flowchart is shown in FIG. 13. When the image reading device A is turned on, the control CPU 54 reads out a program in the ROM 57 to carry out the initial operation (Step 1). In the initial operation, the carriage drive motor 16 is moved within a predetermined range to acquire the correction information (white reference setting, shading correction value setting, etc.) for the photoelectric converter 14. At the end of the initial operation, a home position sensor (not shown) confirms whether the carriage 10 returns to a home position.

Next, the control CPU 54 determines whether the connector 61 of the feeding device B is electrically connected. The determining means is a program stored the control CPU 54, in which, for example, a signal is sent to the connection port between the CPU 54 and the feeding device to determine based on the response to the signal whether the connector 61 is in the connecting condition (Step 2).

Based on the result of the determination, the control CPU 55 selects one of the two operation modes: a mode in which the control CPU 54 controls the feeding device B to feed and set the original; a mode in which the original is manually set on the platen 2. At this time, the reading conditions are set based on input signals from the control panel 4. The reading conditions include color information including monochrome, gray scale, color, resolution information, and the like (widely known and description is omitted).

When the reading start button on the control panel 4 is pushed, the control CPU 54 checks a status signal from the empty sensor S1 of the sheet feeding stacker 17. When no original is on the sheet feeding stacker 17, the control CPU 54 displays on the panel to notify the user. When the original is placed, the control CPU 54 sends a feed-order signal to the feeding device B (Step 3). The control circuit 60 of the feeding device B receives the feed-order signal to rotate the drive motor M in the forward direction. At the same time, the electromagnetic clutch 42 is connected to rotate the paper feed roller 26. The rotation of the drive motor M is also transferred to the transporting roller 37 and transporting belts 19 to prepare for receiving the original.

The paper feed roller 26 rotates to draw out the original on the sheet feeding stacker 17 toward the platen 2, and only the uppermost one is sent through the friction pad 27 and taken over by the transporting roller 37. The sensor S2 provided on a part of the switching gate 40 detects the forward end of the original after reaching the transporting roller 37 (Step 4).

The control circuit 60 turns OFF the electromagnetic clutch 42 in response to a signal from the sensor S2 after a predetermined time set by a timer. The transporting roller 37 feeds the original toward the transporting belts 19 onto the platen 2. At this time, the vacuum fan 29 is rotating according to the feed-order signal, and sucks the original entering on the platen 2 toward the transporting belts 19, so that the transporting belts 19 transport the original.

When the forward end of the original hits the original stoppers 51, the original slides relative to the transporting belts 19 and stops. After an estimated time that the forward end of the original reaches the original stopper 51 through the timer activated by the signal from the sensor S2, the control circuit 60 cuts power to the drive motor M. The control circuit 60 sends an original feeding and setting completion signal to the image reading device A (Step 4).

The control section 9 in the image reading device A starts to read an image on the original under the set conditions. The image data thus acquired is corrected for an effective reading start position corresponding to L1 in the main scan direction and an effective reading start position corresponding to L2 for the sub-scan direction (FIG. 6). The data processing is carried out, and the resultant data is transmitted from the data output section 8 to the external device such as a computer.

When the carriage 10 returns to a start position after the reading scan, the control section 9 sends a discharge-order signal to the feeding device B (Step 5). The control circuit 60 of the feeding device B rotates the drive motor M in reverse in response to the discharge-order signal. The reverse rotation of the motor M drives the transporting belts 19 in the reverse direction and drives the transporting roller 37 through the one-way clutch in the constant direction, while the paper feed roller 26 stays idle where the electromagnetic clutch 42 is in OFF. As a result, the original is transported leftward in FIG. 3 to the transporting guide 36 by the pick-up guide 41 through the switching gate 40, and is stored on the discharge stacker 18.

When the sensor S2 located at an upstream side of the discharge stacker 18 detects the rear end of the original, the sensor S2 sends a discharge-completion signal to the control section 9 and waits for the next feed-order signal (Step 6).

In the mode in which the feeding device B is not used, when the reading start button on the control panel 4 is pushed, the control CPU 54 controls the drive motor 16 of the carriage 10 to start to read an image on the original under the set conditions. The image data thus acquired is corrected for the predetermined original setting reference, i.e. the effective reading start positions 5*a* and 5*b* shown in FIG. 7, and for the sub-scan direction. The data processing is carried out, and the resultant data is transmitted from the data output section 8 to the external device such as a computer. (Step 7)

In other words, when the reading start button on the control panel 4 is pushed, the control CPU 54 checks a status signal from the empty sensor S1 in the sheet feeding stacker 17. When no original is on the sheet feeding stacker, the control CPU 54 displays on the panel to notify the user. When the original is set, the control CPU 54 sends the feed-order signal to the feeding device B to rotate the drive motor M in the feeding device in the forward direction.

Concurrently, the electromagnetic clutch 42 is connected to rotate the feed roller 26. The rotation of the drive motor M is also transferred to the transporting roller 37 and transporting belts 19 to prepare for receiving the original.

The paper feed roller 26 rotates to feed the original on the sheet feeding stacker 17 toward the platen 2, and only the uppermost original is sent through the friction pad 27 and taken over by the transporting roller 37.

When the forward end of the original reaches the transporting roller 37, the electromagnetic clutch 42 is turned OFF according to the timer activated by the feed-order signal. The transporting roller 37 transports the original toward the transporting belts 19 onto the platen 2. At this time, the vacuum fan 29 is rotating according to the feed-order signal, and sucks the original on the platen 2 toward the transporting belts 19, so that the transporting belts 19 transports the original.

When the forward end of the original hits the original stoppers 51, the original slides relative to the transporting belts 19 and stops. After an estimated time that the forward end of the original reaches the original stoppers 51 through the timer activated by the signal from the sensor S2, the control circuit 60 cuts power to the drive motor M. The control section 9 in the image reading device A starts to read an image on the original under the set conditions.

The image data thus acquired is corrected for the effective reading start position corresponding to L1 in the main scan direction and the effective reading start position corresponding to L2 for the sub-scan direction. The data processing is carried out, and the resultant data is transmitted from the data output section 8 to the external device such as a computer.

When the carriage 10 returns to the start position after the reading scan, the control section 9 sends the discharge-order signal to the feeding device B. The control circuit 60 of the feeding device B rotates the drive motor M in reverse in response to the discharge-order signal. The reverse rotation of the motor M drives the transporting belts 19 in the reverse direction and drives the transporting roller 37 through the one-way clutch in the constant direction, while the paper feed roller 26 stays idle where the electromagnetic clutch 42 is in OFF. As a result, the original is transported leftward in FIG. 3 to the transporting guide 36 by the pick-up guide 41 through the switching gate 40, and is stored on the discharge stacker 18.

When the sensor S2 located at an upstream side of the discharge stacker 18 detects the rear end of the original, the sensor S2 sends a discharge-completion signal to the control section 9 and waits for the next feed-order signal.

During the process, the lateral positioning members 49 provided on the device frame 20 abuts against the steps 5*a*, 5*b*, 5*c*, and 5*d* at the flange, so that the feeding device B is positioned with respect to the platen 2 of the image reading device A. Accordingly, the device frame 20 is positioned over the platen 2 in the lateral direction, so that the optical reading mechanism 6 of the image reading device A and the feeding device B are precisely positioned relative to the original. Further, the vertical positioning members 50 of the transporting case frame 21 mounted to the device frame 20 regulate the gap between the platen 2 and the transporting belts 19 precisely, so that the original is transported along the platen reliably.

As described above, according to the present invention, the document feeder includes the device frame to be placed on the platen of a scanner and the like; the sheet feeding stacker and the discharge stacker mounted to the device frame; the transporting belts mounted to the device frame; the lateral positioning members for laterally restricting the transporting belt; and the vertical positioning members for vertically restricting the transporting belt. The vertical positioning members abut against the flange portion at the peripheral side of the platen for positioning, and the vertical positioning members abut against the platen surface for positioning.

Accordingly, it is possible that the feeding device is mounted and dismounted easily only by placing the device on the platen. The feeding device is easy to handle as a device for automatically feeding a special original including a photograph.

According to the present invention, the frame is composed of the device frame for covering the entire platen region (maximum reading area), and the transporting case frame for covering a part of the platen. The device frame is provided with the lateral positioning members and the transporting case frame is provided with the vertical positioning members, thereby making the document feeder for transporting a special original of a small size, i.e. a photograph, compact.

According to the present invention, the document feeder includes the device frame to be installed on the platen; the transporting belts provided to the device frame for transporting the original along the platen; and the original stoppers for stopping the original. The original stoppers are disposed at the different locations away from the original setting reference. The transporting belts transport and set the original at a location closer to the center of the platen rather than the end portion thereof, thereby preventing the deterioration of the image quality due to light leakage during exposure can be. The original stoppers are movable to a plurality of locations according to the longitudinal size of the original conveyed onto the platen, thereby minimizing the transporting path of the original and reducing damage on the originals and transportation trouble.

While the invention has been explained with respect to the specific embodiments of the invention, the explanation is illustrative and the invention is limited only by the appended claims.

What is claimed is:

1. A document feeder comprising:

a frame to be placed on a platen of an image reading device, transporting means attached to the frame with a gap relative to the platen for transporting an original and having a transporting belt, a sheet feeding stacker disposed adjacent to the transporting means for feeding the original to the transporting means, a discharge stacker disposed adjacent to the transporting means for storing the original transported from the transporting means, a flange portion of the plate at a side edge, a lateral positioning member provided on the frame for abutting against the flange portion of the platen to laterally restrict a position of the transporting means, and a vertical positioning member provided on the frame for abutting against a surface of the platen to vertically restrict the position of the transporting means.

2. A document feeder according to claim 1, wherein said transporting means further includes sucking means for sucking the original toward the transporting belt, said frame having a shape covering an entire portion of the platen, said transporting belt having a shape covering a portion of the platen, said lateral positioning member being disposed at an outer peripheral edge portion of the frame, said vertical positioning member being disposed at a peripheral edge portion of the transporting belt.

3. A document feeder according to claim 1, wherein said lateral positioning member includes portions abutting against the flange portion of the platen on at least two adjacent side edges of the platen.

4. A document feeder according to claim 1, wherein said lateral positioning member is arranged to be movable vertically while engaging the surface of the platen, and is disposed at a position away from the surface of the platen.

5. A document feeder according to claim 1, further comprising an original stopper disposed on the frame for stopping the original transported by the transporting belt, said lateral positioning member controlling a position of the original stopper relative to an original setting reference and arranging the original stopper away from the original setting reference.

6. A document feeder according to claim 5, wherein said lateral positioning member includes projections abutting against the original setting reference.

7. A document feeder according to claim 5, wherein said sheet feeding stacker and said transporting belt are arranged substantially horizontally along the platen, said discharge stacker being disposed above the sheet feeding stacker.

8. A document feeder to be placed on a platen of an image reading apparatus for transporting an original to the platen, comprising:

a device frame covering a maximum reading area of the platen, a transporting case frame attached to the device frame and covering a part of the platen, a light-shielding cover member disposed on the device frame for blocking light through the platen, transporting means disposed on the transporting case frame for transferring the original to the platen and having a transporting belt, a lateral positioning member disposed on the device frame for abutting against a flange portion of the platen at a side edge thereof to laterally restrict a position of the transporting belt, and a vertical positioning member disposed on the transporting case frame for abutting against a surface of the platen to vertically restrict the position of the transporting belt.

9. A document feeder according to claim 8, further comprising an exterior casing formed integrally with the device frame, a sheet feeding stacker disposed on the device frame for placing the original, a discharge stacker disposed on the device frame, and a vacuum chamber disposed on the transporting case frame for sucking the original toward the transporting belt.

10. A document feeder according to claim 9, wherein said lateral positioning member and vertical positioning member are disposed outside an area of an original having a maximum size such that the transporting belt can transport, said transporting belt and said vertical positioning member being disposed on the vacuum chamber.

11. A document feeder according to claim 8, wherein said lateral positioning member is arranged to be movable vertically while engaging the surface of the platen, and is disposed at a position away from the surface of the platen.

12. A document feeder according to claim 8, wherein said device frame and transporting case frame are arranged to be movable vertically relative to the platen.

13. A document feeder according to claim 8, further comprising an original stopper disposed on the device frame for stopping the original transported by the transporting belt, said original stopper being arranged to abut against the flange portion of the platen and set by a lateral positioning member and disposed away from the flange portion of the platen.

14. A document feeder according to claim 13, wherein said device frame and transporting case frame are independent members, said transporting case frame being attached to the device case frame such that a position of the transporting case frame can be adjusted freely, said original stopper being attached to the device case frame such that the position of the original stopper can be adjusted freely.

15. An image reading apparatus comprising:

The document feeder according to claim 1, the platen for placing an original, and photoelectric converting means disposed adjacent to the original on the platen.

16. An image reading device according to claim 15, wherein said frame includes a first frame for supporting the sheet feeding stacker and discharge stacker, and a second frame mounted to the first frame for supporting the transporting belt, said first frame being provided with the lateral positioning member and said second frame being provided with the vertical positioning member.

17. An image reading apparatus according to claim 15, further comprising an original stopper disposed on the frame for stopping the original transported by the transporting belt, an original setting reference disposed on the frame away from the original stopper for placing the original, and control means for controlling the photoelectric converting means to start reading the original from the original setting reference in a first mode and to start reading the original from the original stopper in a second mode.

18. An image reading apparatus according to claim 17, further comprising mode-selecting means electrically connected to the control means for selecting one of the first mode and the second mode, and detecting means electrically connected to the control means for detecting whether the transporting belt is on the platen, said control means setting one of the first mode and the second mode.

19. An image reading apparatus according to claim 17, wherein said control means includes determining means for determining whether a control circuit of the transporting belt is connected to a control circuit of the photoelectric converting means.

20. An image reading apparatus according to claim 17, further comprising a movable side edge guide disposed on the sheet feeding stacker for restricting a side edge of the original, said original stopper being interconnected to the movable side edge guide and being arranged to be movably freely to a plurality of positions along a direction that the photoelectric converting means moves.

* * * * *